United States Patent [19]

Cooper

[11] Patent Number: 4,492,319

[45] Date of Patent: Jan. 8, 1985

[54] METHOD AND APPARATUS FOR ENHANCING THE FIRE COMBATANT PROPERTIES OF SAFETY CANS

[76] Inventor: Clinton T. Cooper, 105 Overhill Rd., Youngstown, Ohio 44512

[21] Appl. No.: 405,021

[22] Filed: Aug. 9, 1982

[51] Int. Cl.[3] ..... B67D 1/16

[52] U.S. Cl. ..... 222/108; 222/511; 220/88 R

[58] Field of Search ..... 222/108, 189, 402.12, 222/470, 472, 491, 492, 511, 517, 531, 532, 558, 567, 566; 220/85 VR, 88 R, 88 A, 88 B; 239/122, 499; 137/377, 380

[56] References Cited

U.S. PATENT DOCUMENTS

| | | | |
|---|---|---|---|
| 2,552,444 | 5/1951 | Nielsen | 239/499 |
| 3,203,454 | 8/1965 | Michallef | 222/402.12 X |
| 3,729,122 | 4/1973 | Flider | 222/469 |
| 3,935,973 | 2/1976 | Weyn | 222/182 |
| 4,212,315 | 7/1980 | Fahl et al. | 137/377 |

FOREIGN PATENT DOCUMENTS

| | | |
|---|---|---|
| 1246417 | 9/1971 | United Kingdom . |

*Primary Examiner*—H. Grant Skaggs
*Assistant Examiner*—Michael S. Huppert
*Attorney, Agent, or Firm*—David A. Burge

[57] ABSTRACT

A safety can for flammable liquid having a pressure relief cap which can lift slighly from the spout to form an escape orifice in response to internal pressure has its fire combatant properties enhanced by providing a skirt surrounding the location of the escape orifice. The skirt is located at such a level that it interrupts the radial spray pattern of flammable material spraying from the orifice and redirects this material in such a way that it tends to collect in the vicinity of the can.

8 Claims, 7 Drawing Figures

METHOD AND APPARATUS FOR ENHANCING THE FIRE COMBATANT PROPERTIES OF SAFETY CANS

REFERENCE TO DISCLOSURE DOCUMENT

Reference is made to Disclosure Document No. 108,125, filed May 3, 1982, the disclosure of which is incorporated herein by reference.

BACKGROUND OF THE INVENTION

1. Field of the Invention

The present invention relates generally to small portable containers for storing, transporting and dispensing volatile flammable liquids such as gasoline, and to methods and devices for enhancing their fire combatant properties. Containers of this type are frequently referred to as safety cans.

2. Prior Art

Safety cans commonly in use have tubular filling and/or dispensing spouts closed either by threaded caps or by hinged spring closures. Threaded caps provide a firm closure, but are disadvantageous in that they are awkward to manipulate in normal use and are suitable only for situations where the use of the container is rather infrequent. While threaded caps may be provided with vent openings, such openings may not be sufficient to prevent bursting of the container under a rapid buildup of internal pressure.

For cans in frequent use, it has become accepted to provide their spouts with hinged, spring-biased closures which can be quickly opened either by direct manual contact or by an operating lever associated with the can's carrying handle. Such closures are normally biased closed in such a way that the closure can open slightly, in the manner of a relief valve, to relieve any buildup in internal pressure before it can reach a value threatening the integrity of the can.

The use of spring biased closures on safety cans may, in certain special situations, present a problem. If a safety can containing a flammable liquid such as a gasoline can should be surrounded by a local fire, the flammable contents of the can may boil and partially vaporize, causing a buildup in pressure within the can that is sufficient to cause the closure to lift slightly above the spout opening to relieve the pressure buildup. Once the closure has lifted, a mixture of flammable vapor and liquid is permitted to escape as a spray through an annular escape orifice formed between the spout opening and the closure. The spray pattern of this discharge of volatile material through the escape orifice is generally planar and extends radially outwardly from the axis of the spout. Due to the pressure at which the volatile mixture discharges and the restricted nature of the escape orifice, the spray may project radially outwardly for a distance of several feet from the can, and, when ignited, may tend to cause the local fire to spread.

SUMMARY OF THE INVENTION

The present invention overcomes the foregoing and other drawbacks of the prior art by providing an exceedingly simple and inexpensive system which renders more safe the use of spring pressed closures on safety cans.

The system of the present invention prevents the spreading of a local fire about a safety can due to pressure induced spraying of the container contents through an escape orifice which is provided when a spring pressed closure is forced to open slightly by internal pressure. This result is achieved by providing a skirt in the form of a narrow band of sheet material spaced from and surrounding the escape orifice. The skirt is positioned at a level such that it will intercept any laterally sprayed material exiting through the escape orifice, i.e., between the spout and the closure. The interception of the radially sprayed material will cause its laterally outwardly motion to be interrupted so that it will collect and drain downwardly so as to remain within the general vicinity of the can.

The skirt may take a variety of forms. In one form the skirt may be constructed as a permanent part of the spout, either integral therewith or permanently attached thereto. On the other hand it may be so constructed as to be releasably applied to the container spout as an attachment thereto, whereby it may be sold separately for retrofitting existing safety cans. In another form of the invention the skirt movably mounted and arranged to be movable with a spring pressed spout closure.

BRIEF DESCRIPTION OF THE DRAWING

The foregoing and other features of the present invention will be better understood by referring to the description of the preferred embodiments and the claims which follow, taken in conjunction with the accompanying drawings, wherein:

DESCRIPTION OF THE PREFERRED EMBODIMENTS

Figure 1:
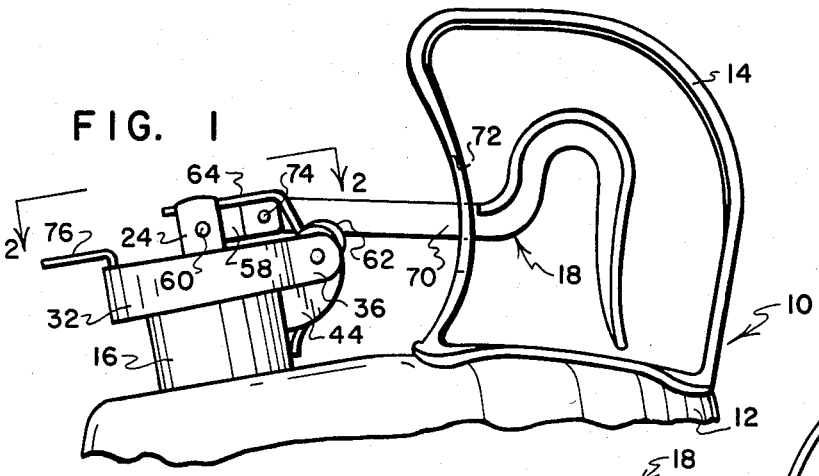
FIG. 1 is a side elevational view of an upper portion of a safety can showing a dispensing spout including a spray restricting skirt which incorporates features of the present invention.

Referring to FIG. 1, upper portions of a safety can are indicated generally by the numeral 10. The can 10 includes a container body 12 to which is affixed an upwardly extending carrying handle 14. Located to one side of the carrying handle 14 is a spout 16 which is designed to serve both as a filling spout for introducing liquid into the container body 12, and as a dispensing spout for pouring liquid from the container body 12. A control lever 18 is positioned so that it can be grasped by the same hand which engages the handle 14.

Figure 2:
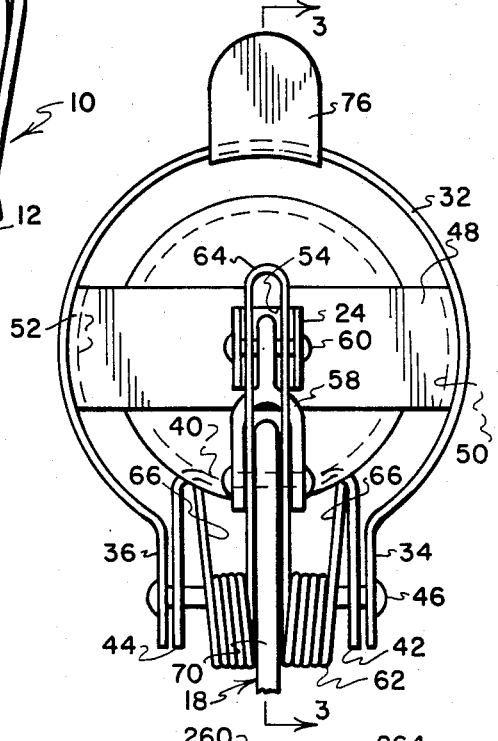
FIG. 2 is a plan view as seen from a plane indicated by a line 2—2 in FIG. 1.
Figure 3:
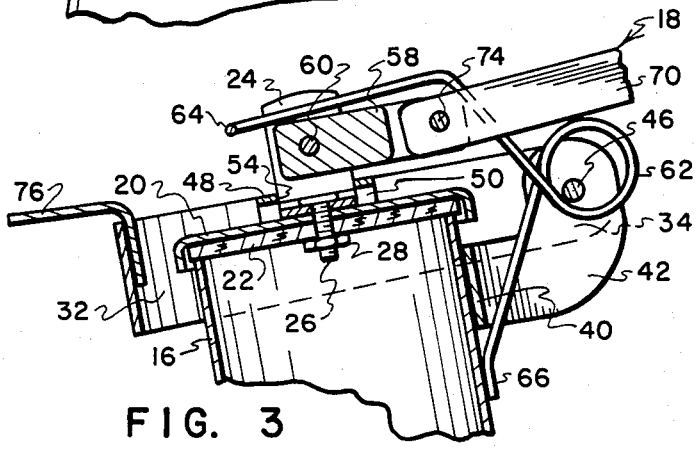
FIG. 3 is a sectional view as seen from a plane indicated by a line 3—3 in FIG. 2.
Figure 4:
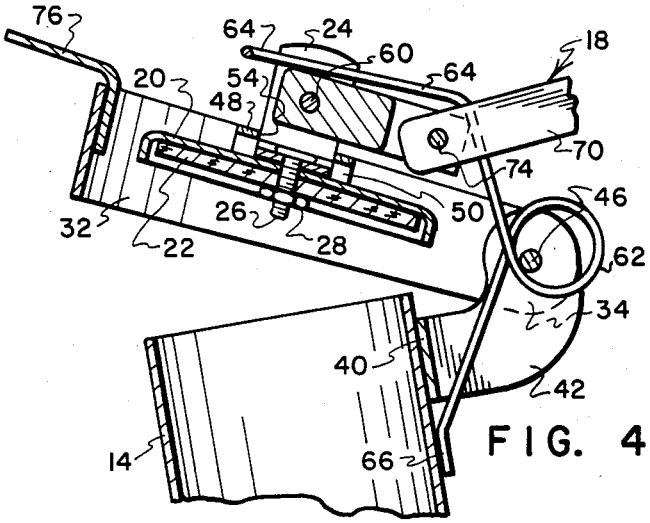
FIG. 4 is a sectional view similar to FIG. 3 but illustrating the spout closure in an open position.

Turning now to FIGS. 2, 3 and 4, it will be seen that the upper open end of the spout 16 is normally closed by a cap or closure 20 which carries a resilient sealing liner 22 on its under surface. Secured to the upper surface of the cap 20 is a U-shaped bracket 24. A convenient means for assembling the parts is shown in the drawing, there being central openings formed in the bottom of the U-shaped bracket 24, the cap 20 and the liner 22, through which is passed any suitable fastening means such as a screw 26 secured by a nut 28.

Surrounding the upper end of the spout 16 and the cap 20, when the cap 20 is in its closed position, is a band of sheet metal forming a skirt 32. As will be seen especially in FIG. 3, this skirt is spaced radially from the spout and cap 14, 20, and is pivotally mounted on the spout 16. The pivotal mount includes a pair of ears 34, 36, one at each end of and integral with the skirt 32, and a fixed bracket 40 secured, as by welding, to the side of the spout 16 nearest the carrying handle 14. The bracket 40 has spaced arms 42 and 44. A pivot pin 46 passes through suitable openings formed in the ears 34, 36 of the skirt 32 and the arms 42, 44 of the bracket, thereby pivotally supporting the skirt 32 on the bracket 40.

An interconnection between the skirt 32 and the cap 20 is provided in the form of a cross plate or spreader 48 which has its opposite ends 50, 52 attached to the skirt 32 as by welding. The spreader 48 has a central rectangular opening 54 which snugly receives the upstanding portions of the U-shaped bracket 24 and thereby mechanically associates the skirt 32 and the cap 20. A clevis member 58, whose primary function will presently appear, has one end associated with the upper portion of the U-shaped bracket 24 by means of a pin 60. The spreader 48 is therefore trapped between the clevis member 58 and the cap 20, so that the skirt 32 and the cap 20 are constrained to move in association with each other. The pivotal mounting for the skirt 32 serves to provide the pivotal mounting for the cap 20 as well.

A double coil hinge spring 62 has its coils embracing the pin 46. Its central arm 64 acts downwardly against the clevis member 58. Its outer arms 66 act against the side of the spout 16. The spring 62 is stressed in a direction such that it biases the cap 20 toward its closed position with a predetermined force.

The cap 20 is normally opened in opposition to the force of spring 62 by manipulation of the control lever 18. The lever 18 has a shank 70 which passes loosely through a guide opening 72 in the carrying handle 14 and is pivotally connected to the clevis member 58 by a pin 74. Alternate direct manual operation to open the cap 20 may be provided for, if desired, by attaching a projecting tab 76 to one side of the skirt 32.

By having the skirt 32 movable with the cap 20 as in the form of the invention shown in FIGS. 1 to 4, the skirt 32 will be moved to an inactive position whenever the cap 20 is intentionally opened for pouring liquid from the spout 16. This will minimize the chance for the skirt 32 to interfere with liquid being poured from the spout 16. It will be understood however, that, if desired, this arrangement can also be associated with a spout which is essentially designed for filling only.

The foregoing description sets out in some detail the construction of one form of the invention designed especially for use in connection with a dispensing spout on a safety can and in which there is a skirt 32 that normally surrounds the spout opening and the cap. Should the cap 20 lift slightly due to internal pressure within the can 10 whereby an annular orifice is formed between the spout 16 and the cap 20, any escaping flammable fluids will not spray radially for any substantial distance, but will, instead, be intercepted by the skirt 32. Thus, discharging contents will be directed as to collect in the vicinity of the can 10 itself, thereby preventing the spread of a localized fire to which the can 10 may be subjected.

Figure 7:
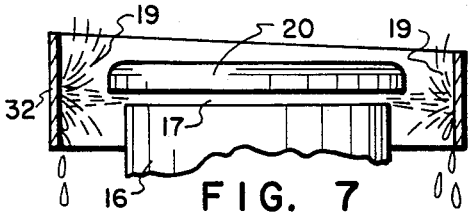
FIG. 7 is a diagrammatic elevational view, partly in cross section, illustrating the operation of the spray restricting skirt of the present invention.

The general principle of operation of the skirt 32 is illustrated diagrammatically in FIG. 7 wherein the cap 20 is shown slightly lifted from the container spout 16 to form a constricted annular escape orifice 17. If the volatile flammable liquid in the container 10 is boiling and producing a rise in internal pressure which causes raising of the cap 20 against its spring loading, a spray 19 will issue radially from the escape orifice 17. When the skirt 32 is properly positioned surrounding the spout 16 in spaced relationship thereto, it will intercept this radially-directed spray and cause it to be so directed that the sprayed material will drain downwardly and remain in the vicinity of the safety can 10 where it will burn locally rather than causing a local fire to spread over a substantially wider area.

In the form of the invention shown in FIGS. 1 to 4 the skirt 32 extends substantially but not completely around the escape orifice 17 formed between the cap 20 and the spout 16. It will be noted that in this specific construction the skirt 32 does not extend entirely circumferentially about the escape orifice 17. Where the skirt 32 does not so extend to completely encircle the orifice 17, sufficient spray pattern obstruction in the rightward direction (as viewed in FIG. 2) is provided by the hinge elements, namely arms 42, 44, mounting ears 34, 36, pin 46 and the coils of hinge spring 62.

Figure 5:
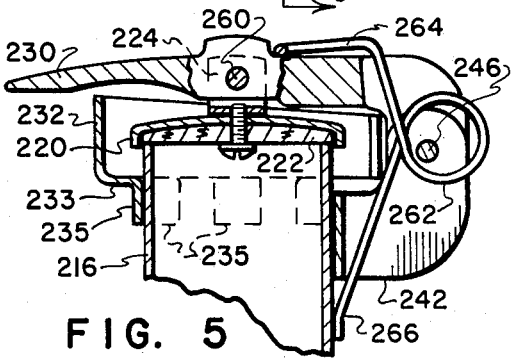
FIG. 5 is a sectional view similar to FIG. 3, but illustrating an alternate form of spray restricting skirt which incorporates features of the present invention.
Figure 6:
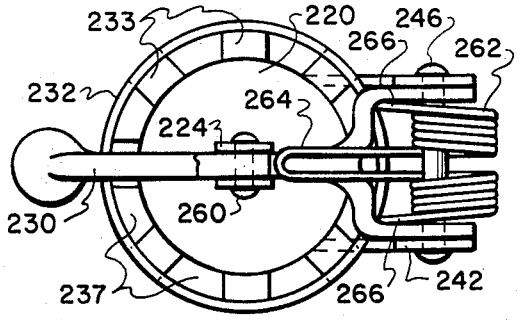
FIG. 6 is a top plan view of the device of FIG. 5.

An alternate form of the invention is illustrated in FIGS. 5 and 6, wherein a spout 216 has its open end cooperating with a closure or cap 220 including a liner 222 and a U-shaped bracket 224. The cap 220, liner 222 and bracket 224 are all connected by a fastener 226 in a manner similar to that described in conjunction with the embodiment of FIGS. 1–3. A bracket 242 welded to the side of the spout 216 pivotally supports an operating lever 230 by means of a pin 246. The operating lever is connected with the U-shaped bracket 224 by a pin 260.

A double coil hinge spring 262 surrounds the pin 246, and its central arm 264 acts downwardly against the operating lever 230 while its outer arms 266, 266 act against the spout 216. With this construction, the tip of the lever 230 can be manually grasped to disengage the cap 220 from the spout 216 against the force of the spring 262.

A skirt 232 is mounted on the spout 216. The skirt 232 is independent of the cap 220. The skirt 232 has inwardly extending arms 233 culminating in tabs 235 which may be affixed permanently to the spout 216 as by welding. Alternately, the tabs 235 may compressively engage the spout 216, whereby the skirt 232 can be sold separately to retrofit existing safety cans.

The arms 233 serve to space the skirt 232 radially outwardly from the spout 216 and the cap 223. Spaces 237 provided between the arms 233 provide drain passages to prevent accumulation of such liquid as may be released from the container when conditions can cause the contents to spray from an annular orifice formed between the end of the spout 216 and the slightly lifted cap 220.

The principle of operation, as explained above in connection with the FIG. 7 diagram, applies with equal force to the embodiment of FIGS. 5 and 6. The embodiment of FIGS. 5 and 6 is mainly intended for use on filler spouts of safety cans wherein the filler spout is independent of a dispensing spout.

From the foregoing description it is apparent that in addition to the apparatus described herein, applicant has developed in general a method for enhancing the fire combatant properties of safety cans by the steps of providing a skirt for installation about a cap or spout of a safety can to interrupt any radial spray of the material issuing from the orifice formed between the cap and the spout when the cap lifts to relieve internal pressure, and to redirect the sprayed flammable material in such a fashion that it tends to accumulate in the general vicinity of the can.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. In a safety can for flammable liquid comprising a container body for holding flammable liquid, a spout projecting generally upwardly from the container body and having an opening, a closure member movably mounted on the safety can for movement between open and closed positions for selectively opening and closing the spout opening, and means for biasing the closure member toward its closed position but capable of being overcome by pressure within the container beyond a predetermined value to allow the closure member to lift sufficiently from its closed position to form a substantially annular orifice through which contents of the safety can may spray to relieve such pressure, the improvement comprising skirt means mounted on the safety can and having the form of a strip of sheet material that defines an upwardly and downwardly opening, generally tubular skirt that substantially surrounds but is spaced from the orifice for intercepting the spray pattern created when the closure member moves from its closed position under the influence of pressure within the container, and for redirecting the spray of escaping fluid such that it will accumulate in the immediate vicinity of the safety can.

2. The safety can of claim 1 wherein the skirt is connected to the closure and is movable therewith between its open and closed positions.

3. The safety can of claim 2 wherein the skirt is movably mounted on the can for movement in concert with the closure as the closure moves between its open and closed positions.

4. The safety can of claim 1 wherein the skirt is rigidly connected to the spout.

5. In a safety can for flammable liquid comprising a container body for holding flammable liquid, a spout projecting from the container body and having an opening, a closure member movably mounted on the can for opening and closing the spout opening, and means for biasing the closure member toward its closed position but capable of being overcome by pressure within the container beyond a predetermined value to allow the closure member to lift and form an annular orifice through which contents of the can may spray to relieve such pressure, the improvement comprising skirt means mounted on the spout of the safety can and including a skirt in the form of a strip of material substantially surrounding but spaced from the orifice for intercepting the spray pattern created when the closure member lifts, and for redirecting the spray such that it will accumulate in the immediate vicinity of the can, the mounting of the skirt on the spout being effected by means comprising arms located at intervals around the skirt and extending inwardly thereof with their inner ends connected to the spout, and wherein there are spaces between the arms providing drainage for intercepted spray.

6. An attachment for a safety can comprising a generally upwardly projecting spout, a closure member movably mounted on the can for movement between open and closed positions for selectively opening and closing the spout opening, and means for biasing the closure member toward its closed position but capable of being overcome by internal pressure within the container beyond a predetermined value to allow the closure member to lift from its closed position and to cooperate with the spout to form an annular orifice allowing the pressure to be relieved, said attachment comprising:

(a) skirt means in the form of a strip of sheet material that defines an upwardly and downwardly opening, generally tubular skirt that is configured to substantially surround the spout opening at a location spaced therefrom; and, (b) means attached to the skirt means for mounting the skirt means on the spout of a safety can at a level such that the skirt means will interrupt a spray of fluid that is escaping from the container through the substantially annular orifice when the closure member lifts in response to internal pressure, for redirecting the spray of escaping fluid such that it will accumulate in the immediate vicinity of the can.

7. An attachment for a safety can comprising a projecting spout, a closure member movably mounted on the can for opening and closing the spout opening, and means for biasing the closure member toward its closed position but capable of being overcome by internal pressure within the container beyond a predetermined value to allow the closure member to lift and form an annular orifice allowing the pressure to be relieved, said attachment comprising:

(a) a skirt of sheet material configured to substantially surround the spout opening at a location spaced therefrom;

(b) mounting means attached to the skirt for mounting the skirt on the spout of a safety can at a level such that it will interrupt a spray of container contents from the annular orifice created when the closure member lifts in response to internal pressure; and, (c) the mounting means including spaced arms integral with the skirt at intervals therearound and extending inwardly therefrom, and resilient tabs extending from said arms for frictionally gripping a safety can spout when the skirt is forced thereon.

8. A method of enhancing the fire combatant properties of a safety can containing flammable liquid, which can is provided with a generally upwardly projecting a spout having a pressure relief cap capable of lifting from the spout to form an annular orifice for relieving internal pressure, comprising the steps of:

(a) intercepting, at a location near to but spaced from the orifice, a spray of the flammable fluid issuing from the orifice formed when the cap lifts off the spout; and, (b) redirecting the intercepted spray in a path such that it is not widely dispersed but rather tends to accumulate in the immediate vicinity of the can;

(c) the intercepting and redirecting steps being accomplished by positioning a skirt means in the form of strip of sheet material such that it defines an upwardly and downwardly opening, generally tubular skirt that substantially surrounds but is spaced from the orifice for intercepting and redirecting a spray of flammable fluid so that it will accumulate in the immediate vicinity of the safety can.

* * * * *